US009936742B2

(12) United States Patent
Hitchen

(10) Patent No.: US 9,936,742 B2
(45) Date of Patent: Apr. 10, 2018

(54) DUAL POWER MODE ELECTRIC TOOL OPERATION WITH GLOVE

(71) Applicant: Robin Hitchen, Bernardsville, NJ (US)

(72) Inventor: Robin Hitchen, Bernardsville, NJ (US)

( * ) Notice: Subject to any disclaimer, the term of this patent is extended or adjusted under 35 U.S.C. 154(b) by 146 days.

(21) Appl. No.: 15/222,558

(22) Filed: Jul. 28, 2016

(65) Prior Publication Data

US 2018/0027888 A1 Feb. 1, 2018

(51) Int. Cl.

| | |
|---|---|
| ***H01H 35/00*** | (2006.01) |
| ***H01H 83/00*** | (2006.01) |
| ***A41D 1/00*** | (2018.01) |
| ***H01R 13/22*** | (2006.01) |
| ***H01R 25/00*** | (2006.01) |
| ***H01H 47/00*** | (2006.01) |
| ***B25F 5/02*** | (2006.01) |
| ***A41D 1/04*** | (2006.01) |
| ***A41D 19/00*** | (2006.01) |
| ***A41D 27/10*** | (2006.01) |

(52) U.S. Cl.

CPC ..... *A41D 1/005* (2013.01); *A41D 1/04* (2013.01); *A41D 19/0024* (2013.01); *A41D 27/10* (2013.01); *B25F 5/02* (2013.01); *H01H 47/00* (2013.01); *H01R 13/22* (2013.01); *H01R 25/006* (2013.01)

(58) Field of Classification Search

CPC ..... A41D 1/005; A41D 1/04; A41D 19/0024; A41D 27/10; B25F 5/02; H01H 47/00; H01R 13/22; H01R 25/006

USPC ..... 307/116

See application file for complete search history.

(56) References Cited

U.S. PATENT DOCUMENTS

| | | | | |
|---|---|---|---|---|
| 2,311,276 | A | 2/1943 | Wilcox | |
| 3,845,771 | A | 11/1974 | Vise | |
| 6,281,594 | B1 | 8/2001 | Sarich | |
| 6,904,614 | B2 * | 6/2005 | Yamazaki | A41D 19/015 2/159 |
| 7,282,818 | B2 | 10/2007 | Kovarik | |
| 8,336,119 | B2 | 12/2012 | Phelps et al. | |
| 8,945,122 | B2 | 2/2015 | Moua et al. | |
| 9,149,337 | B2 | 10/2015 | Schneider | |
| 2002/0035744 | A1 | 3/2002 | Kolcio et al. | |

* cited by examiner

*Primary Examiner* — Carlos Amaya

(74) *Attorney, Agent, or Firm* — Michael J. Feigin, Esq.; Feigin & Fridman LLC

(57) ABSTRACT

A glove with electrical contacts and a power tool with electrical contacts are electrically coupled together. Before they are coupled, the glove contacts have a high impedance with the power source. Upon coupling, circuitry within the power tool is powered by the electrical current emanating from the glove contacts, and a coded signal is generated. This coded signal is received and causes the gloved contacts to exhibit comparatively lower impedance and conduct a higher current while the coded signal is maintained. During this time, currents at the power supply and powered tool are measured and compared. While these currents remain within prescribed tolerance, the business end of the power-tool is operational or operated.

16 Claims, 6 Drawing Sheets

DUAL POWER MODE ELECTRIC TOOL OPERATION WITH GLOVE

FIELD OF THE DISCLOSED TECHNOLOGY

The disclosed technology relates generally to gloves and, more specifically, to methods of passing current through a glove to operate a tool.

BACKGROUND OF THE DISCLOSED TECHNOLOGY

The heaviest and most bulky part of a hand-held power tool is often the battery. The solution in the art for those who desire a lighter electrically powered tool is usually to connect the tool by wire to a wall power outlet. This works well, but it has the drawback of a cord extending from the tool, which can get tangled, cause others to trip, and is limited in length. Thus, workmen often opt to carry the heavier tools with a battery due to their convenience, but strain to, for example, hold such a tool over their heads for long periods of time while attaching sheetrock to a ceiling.

One attempt to solve this problem is disclosed in U.S. Pat. No. 6,281,594 to Sarich. Here, a person moves his or her feet, and the mechanical impulses are converted into electrical impulses to power a drill. While this may work, the levels of power generation are comparatively lower than a typical 12 volt or higher battery used to power many electrical tools and appears to output the same electric current even when no tool is connected. This could be dangerous.

What is needed is a way to provide power to an electrical tool at least at current output levels as the present technology, while having the portability of a battery without the weight. It must also be carried in a safe environment

SUMMARY OF THE DISCLOSED TECHNOLOGY

The proposed design allows for the battery to be isolate from the tool and worn in a harness by the user. The tool receives power through contacts on a glove mating with contacts on the handle of the tool. A control system monitors output current from the battery and compares it with current at the powered device. This system of feedback and control is used to prevent a potentially hazardous short-circuit condition at the gloved contacts. A glove with a first set of electrical contacts is disclosed. The glove is used with a power tool which has a second set of electrical contacts on a handle region thereof. An electrical circuit within the power tool electrically connects to the second electrical contacts and receives electrical current passed therethrough. The current passes from the first to the second set of electrical contacts in a high impedance state. When the circuit is completed by the contact between the sets of electrical contacts, circuitry within the power tool is powered and outputs a coded signal. A controller, such as within the glove, at a battery, and/or worn by a person who is wearing the glove, switches the output to the second set of electrical contacts from a high impedance state to a low impedance state (compared to the prior state) upon receiving the coded signal.

For purposes of the disclosure, a "high impedance state" is, in embodiments of the disclosed technology, one which has at less than one hundred times (100×) or one thousand times (1000×) the current flow compared to the "low impedance state". That is, "high" and "low" impedance are relative to each other, as used in this disclosure. The high impedance state is sufficient to operate the control circuitry within the powered device. This "high impedance state" however provides insufficient power to operate a "business end" or mechanical device of a powered device. Current in the "high impedance state", in embodiments of the disclosed technology, can be in the range of 10-50 milliamperes whereas in the "low impedance state", current drawn by the tool can be in the range of 5-20 Amps.

The system can also include a battery and an electrical cable in a sleeve of a garment (either or both can be in the sleeve) connecting the battery to the first electrical contacts. The controller can be electrically connected to the electrical cable within the sleeve of the garment or elsewhere, and/or can be between or parallel to the battery and first electrical contacts in the circuit. Upon the controller ceasing to receive the coded signal, the controller switches the output to the high impedance state. A business end of the electrical tool is powered in the low impedance state and is unpowered in the high impedance state, in embodiments of the disclosed technology. The battery can be held in a harness hanging from the garment.

To use the electrical system, in some embodiments a person dons a garment with the electrical cable within the sleeve, hangs the battery from the harness, and puts on the glove with the electrical contacts (first set thereof). They are then ready to use a power tool. A power tool, for purposes of this disclosure, is a tool which converts electrical motion to mechanical motion, or any device which requires or utilizes electrical current to operate. In order to use the power tool, the first set of electrical contacts on the glove are contacted with the second electrical contacts on a handle of the power tool. Control circuitry within the power tool then transmits a coded signal to the power supply to confirm that a valid tool is connected. A "valid tool" is defined as one which comprises control circuitry and pre-programmed codes which causes with the electrical circuitry worn by the person to change the power output there-from The circuit completion can also require manually moving a switch to 'on' to turn the glove contacts 'on' or the power tool 'on,' so that each is ready for use. This can happen before or after the first and second electrical contacts are contacted. When the coded signal is received by the power supply, the output of the power supply is switched to a "low impedance state". Current used by the power tool is continuously measured and transmitted to the power supply. Current at the output of the power supply is measured and compared with that at the power tool. While these currents are equal or within a tolerance range, the output of the power supply remains in the "low impedance state". A business end of the power tool is then used, and eventually, the user thereof releases the handle of the power tool, causing the low impedance state to return to the high impedance state.

When the output is in a low impedance state and the controller detects current outside of a pre-defined acceptable tolerance level, the controller switches the output to a high impedance state or cuts electrical flow entirely from a battery to the first electrical contacts. In this manner, any electrical problems leading to a change in current, cause the device to shut off. Only when current is within an expected range while the tool is in use in the low impedance state (based on current drawn by the power tool), is the low impedance state maintained.

Another way of describing the technology is from the perspective of a glove with first electrical contacts in (located at, inside of, the surface of, or accessible from the surface of) an anterior region of the glove, such as the palm region. Wires electrically connecting the electrical contacts to a controller and battery are also used in this embodiment. Upon the first electrical contacts engaging with second electrical contacts of an electrically powered tool and the controller receiving a coded signal there-from, electrical output from the battery to the first electrical contacts is increased.

The above-described glove can be part of a kit with the electrically powered tool. In such a kit, the electrically powered tool has a handle with the second electrical contacts and a signal generator operable to generate a coded signal upon the second electrical contacts contacting the first electrical contacts before the electrical output from the battery to the first electrical contacts is increased. The electrically powered tool further has a business end thereof which is operated only while the signal generator is generating the coded signal, in embodiments of the disclosed technology.

Another way to describe a kit of an embodiment of the disclosed technology is one with an electrically powered tool and glove. The electrically powered tool has a business end powered by way of two electrical contacts on a handle region. The glove has two electrical contacts on an anterior side of the glove, such that spacing between the two electrical contacts of the glove and the two electrical contacts of the electrically powered tool are identical. The two electrical contacts of the glove output a first lower current, until contacting and completing an electrical circuit with the two electrical contacts of the electrically powered tool. Upon completing the electrical circuit, and transmitting a coded signal to confirm that a valid tool is connected, a second higher current compared to the first lower current is outputted through the two electrical contacts in embodiments.

Any device or step to a method described in this disclosure can comprise, or consist of, that which it is a part of, or the parts which make up the device or step. The term "and/or" is inclusive of the items which it joins linguistically, and each item by itself.

DETAILED DESCRIPTION OF EMBODIMENTS OF THE DISCLOSED TECHNOLOGY

A glove with electrical contacts and a power tool with electrical contacts are electrically coupled together. Before they are coupled, the glove contacts have a high impedance. Upon coupling, circuitry within the power tool is powered by the electrical current emanating from the glove contacts, and a coded signal is generated. This coded signal is received and causes the glove to exhibit comparatively lower impedance while the coded signal is maintained. During this time, the business end of the power tool is operational or operated.

Embodiments of the disclosed technology are described below, with reference to the figures provided.

Figure 1:
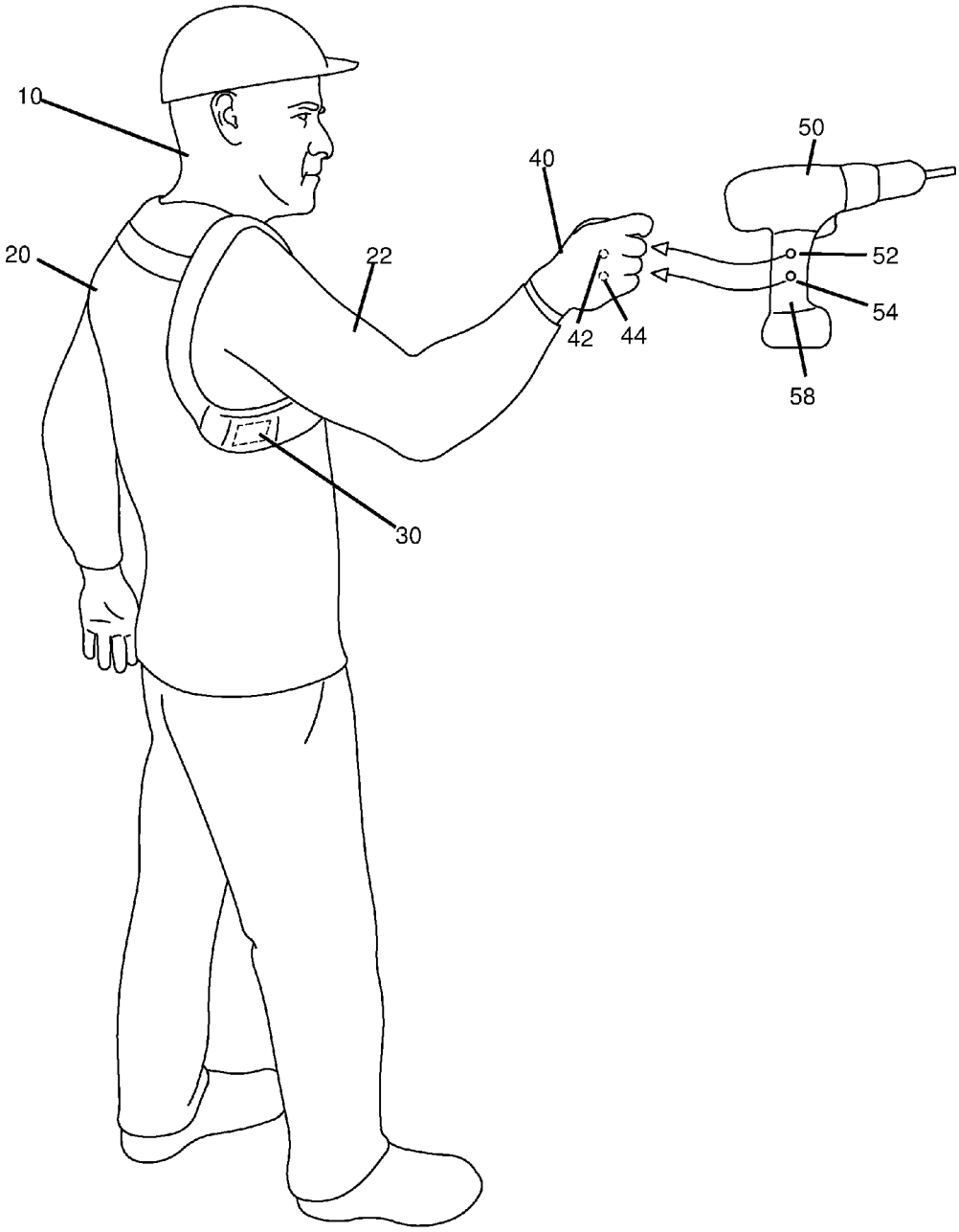
FIG. 1 shows a person ready to use an electric tool and glove, in an embodiment of the disclosed technology.

FIG. 1 shows a person ready to use an electric tool and glove, in an embodiment of the disclosed technology. A person 10 is shown wearing an upper body article of clothing 20, such as a vest having a battery 30 held therein. The clothing has a sleeve 22 covering the arm, in embodiments of the disclosed technology. In other embodiments the garment 20 is sleeveless (the sleeve shown being of another garment). There is a glove 40 which can be a separate garment, or integrated with one or both of the sleeve 22 and upper body article of clothing 20. This glove has one or more electrical contacts, such as contacts 42 and 44 on the palm or anterior side the glove/adapted for placement at an interior side of the hand of a wearer when the glove is donned.

An electrical tool 50, such as a drill, is an electrically operated piece of machinery requiring electrical current to cause some type of mechanical movement, sound, light, display, or the like. This tool 50 has one or more electrical contacts, such as contacts 52 and 54. The contacts 42 and 44 correspond to the contacts 52 and 54 and can be two separate contacts, as shown, or a single interface with two pins or ports, or the like. By grasping the handle region 58 of the tool 50 and physically contacting the contact points of the glove to the tool, one allows electrical current to flow from the battery 30 (in this embodiment, sewn into the garment 20) to the electrical tool 50 by way of wires. The "handle region" is defined as a region of a tool adapted or designed for grasping.

Figure 2:
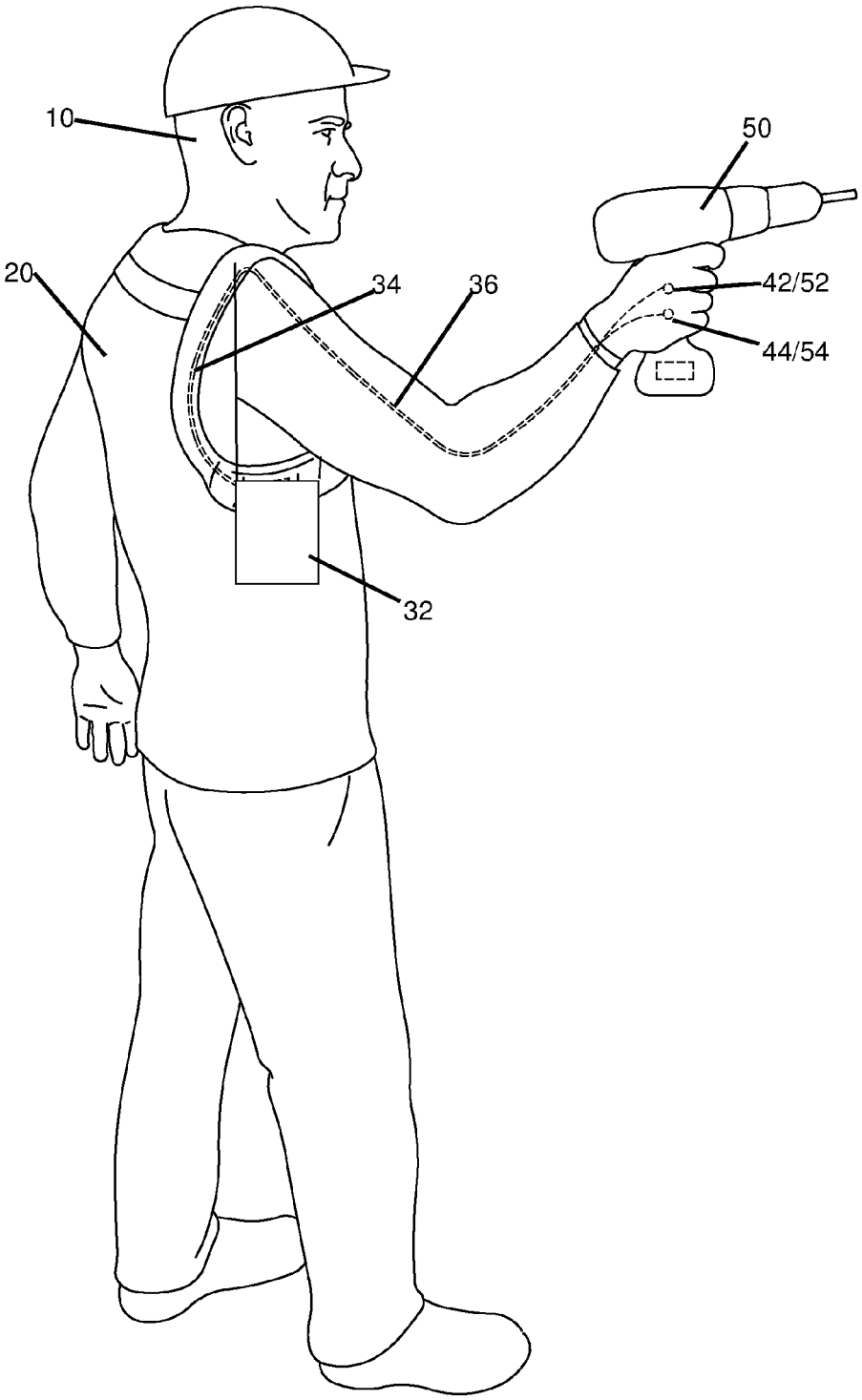
FIG. 2 shows a person using the electric tool and glove, in an embodiment of the disclosed technology.

FIG. 2 shows a person using the electric tool and glove, in an embodiment of the disclosed technology. Here, a second embodiment is shown, with a battery 32 being hung from the garment 20 and/or shoulder of the wearer of the battery 32. A wire connects the battery to the contacts 42 and 44, in order to electrically engage the contacts. Suffice it to say, a power switch may be used as well to turn on electrical connectivity between the battery and contacts 42 and 44. The wire, in embodiments of the disclosed technology, has a portion 36 thereof, which passes through a sleeve 22 of the garment and, in embodiments, has a portion 34 which passes through an upper body covering portion of the garment 20. Either of these parts can be exposed to the outside or sewn into/inside of fabric of the respective garments, or portions thereof. Further shown in FIG. 2, the person is grasping the tool 50, such that the contacts 42 and 44 are in physical contact with the electrical contacts 52 and 54, respectively, of the tool.

Figure 3:
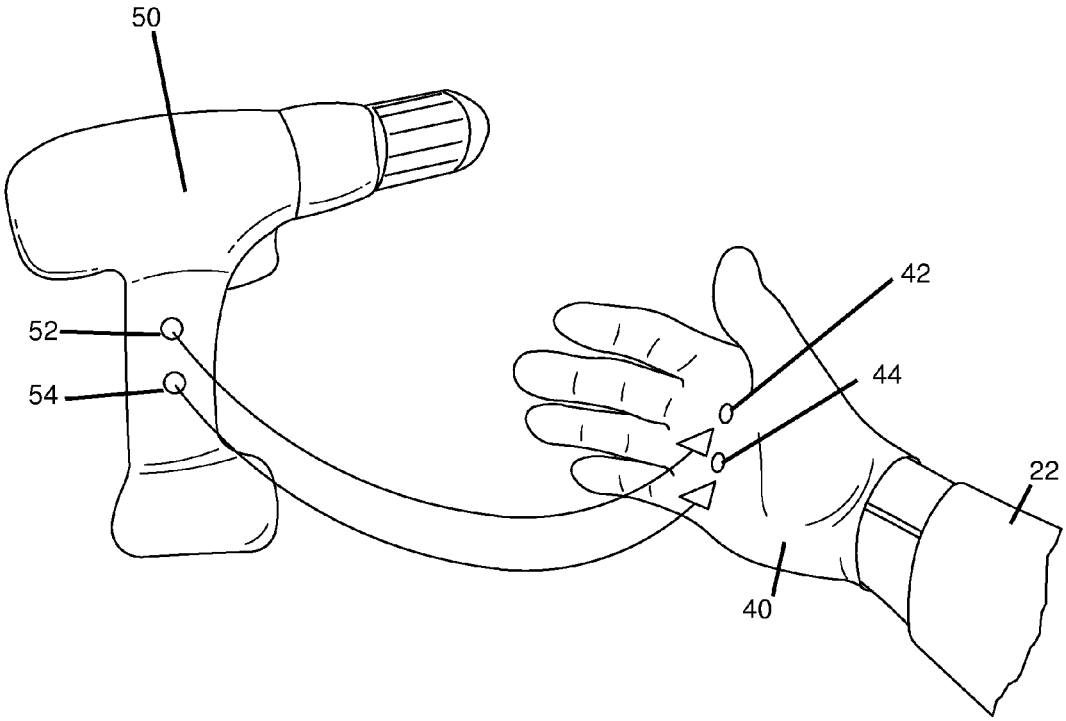
FIG. 3 shows a closer view of a glove and electric tool used in embodiments of the disclosed technology.

FIG. 3 shows a closer view of a glove and electric tool used in embodiments of the disclosed technology. Note that, on the anterior side of the glove 40 and/or hand, the contact points 42 and 44 are shown. These contact points can be held in place relative to the person/wearer due to their position on the glove or otherwise, when used without a glove, held to the hand, such as by way of a strap. The contacts 42 and 44 engage with the contacts of the electrical tool 50, by way of the respective contacts 52 and 54 on the electrical tool.

Figure 4:
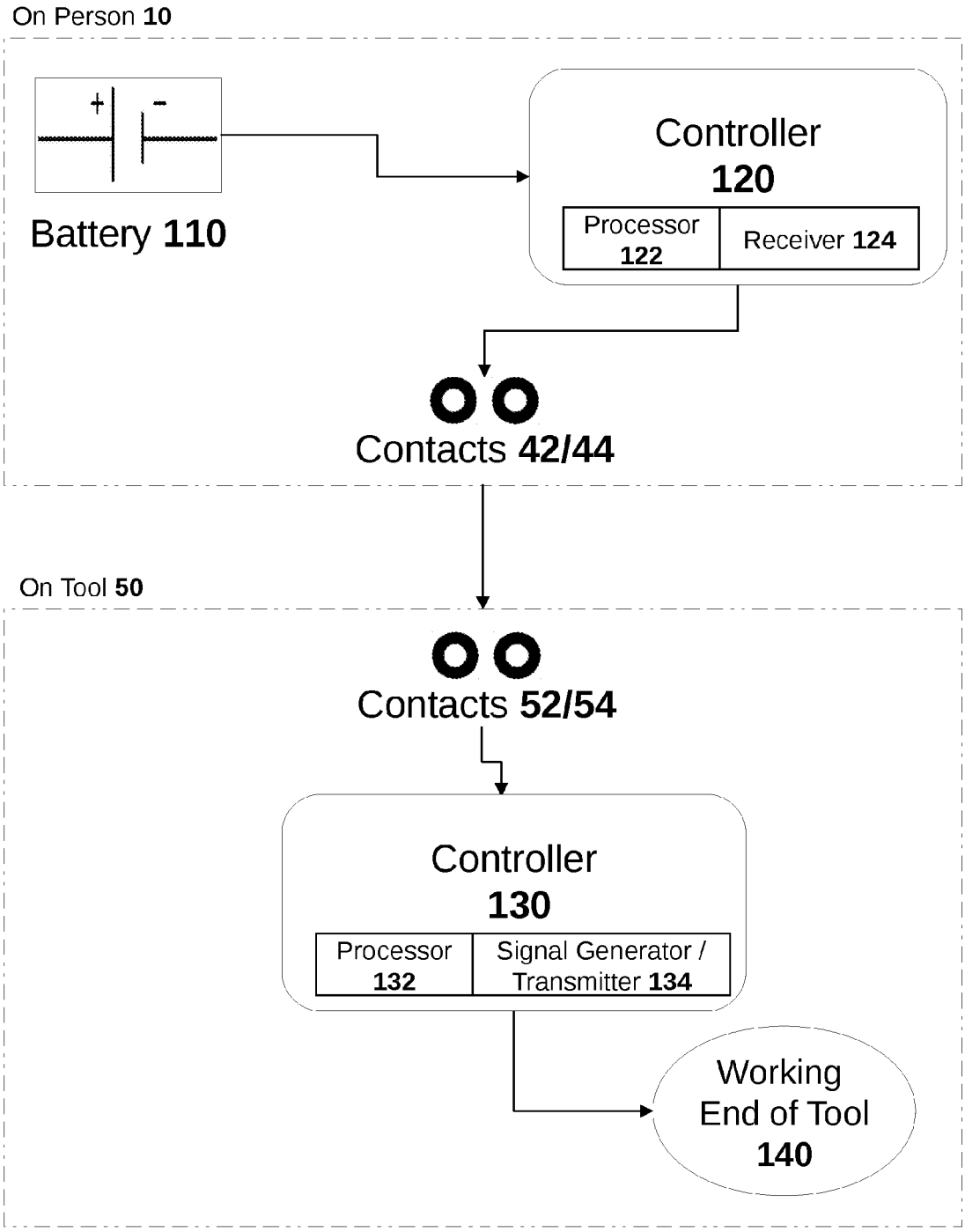
FIG. 4 shows a high level block diagram of devices used in an electrical circuit of the disclosed technology.

FIG. 4 shows a high level block diagram of devices used in an electrical circuit of the disclosed technology. In order to avoid the hazard of a short circuit condition, the low impedance state (as defined in the "summary") is used only when there is an electrical connection between the battery and the business end of the electrical tool 50 and a code has been transmitted to the power supply confirming that a valid tool is connected. The "business end" is the functional part of the electric tool which is also a power sink, and, in some embodiments, the greatest power sink of the devices described herein. Situated on a person, such as person 10, a battery 110 (corresponding to battery 30 or 32 in FIGS. 1 and 2) provides electrical current to a controller 120. "Situated on a person" for this disclosure is defined as hanging from, or supported by, a person's body. The controller 120 has at least a processor 122, which receives and carries out instructions, and a receiver 124, which receives an encoded signal. The contacts 42 and 44 are further electrically connected between, or in line with, the battery 110 and controller 120. The controller 120 can be anywhere on the person, such as in a housing with the battery external to the battery 110. The controller can have any of the devices shown in FIG. 6, such as a processor 122, which receives and carries out instructions. The controller 120 also has a receiver 124. The receiver provides the processor with decoded tool identity and current measurements.

The later contacts are on an electric tool, such as tool 50. A controller 130 receives enough electrical current, even in the high impedance state, to power the controller 130 or a portion thereof, in order to generate a return signal generated by the transmitter or signal generator 134. In embodiments, the coded signal itself provides enough electrical current to power the controller 130. The signal generated by the transmitter or signal generator 134 can be propagated back over the contacts 42, 44, 52, and 54, or via a separate wire or wireless method to the controller 120. Once the second coded signal is received by the controller 120, the processor 122 causes a higher power (low impedance) state from the battery 110 to the working end (business end) of the tool 140. It should further be understood that the transmitter or signal generator 134 can transmit an encoded pattern which is distinct to a particular device or type of device, which is herein referred to as a "DeviceID" or "device identification".

Figure 5:
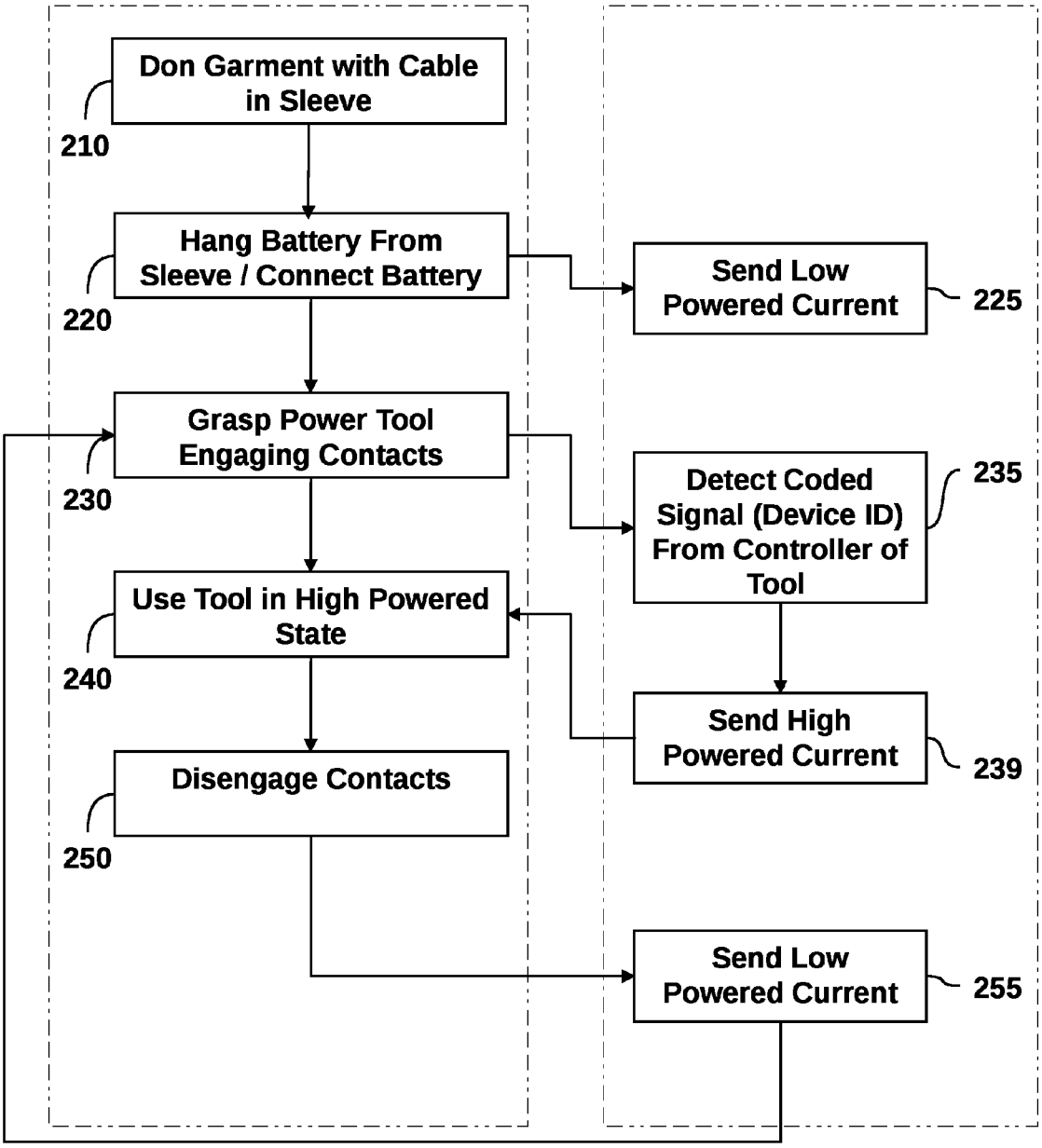
FIG. 5 is a flow chart showing a method of using devices of the disclosed technology.

FIG. 5 is a flow chart showing a method of using devices of the disclosed technology. Boxes on the left are performed by the controller worn by the user. Boxes on the right are actions performed by the controller within the powered device. In step 210, one dons a garment with a cable/wire in the sleeve, and then, in step 220, hangs the battery from the sleeve, garment covering a portion of the body, or otherwise connects a battery, such as battery 30, 32, or 110 to the wire passing through the sleeve. This causes a low-powered current with a coded signal to be sent in step 225. It should be understood that any manner in which the battery, glove (or contacts on the hand, held in any form), and controller are supported by the person are within the scope of the disclosed technology. At this juncture, the contacts between the garment and the electric tool are disconnected and will remain in this state until step 230, when the wearer grasps the tool and engages the contacts on his glove/hand with the electrical contacts of the tool. Once this is done, a controller (e.g. controller 130) within the tool receives enough power to send a coded signal, such as a device ID or other coded signal via wired or wireless communication back to the controller worn by a person. Such a signal is detected in step 235 and upon detection, the electrical current is increased (step 239) in order to power a business end of the tool) step 240). In step 240, the tool is used in the high powered state. In embodiments, a controller worn on a person can send a signal to the device in order for there to be two-way communication between the controllers before step 239 of sending a high powered current. In other embodiments, the communication is one-way only—from the tool's controller to the controller worn or carried by the person.

As long as the contacts remain physically adjacent so as to allow correct to flow from one to another, there is a coded signal sent from a controller of the tool back to the controller on a person. As soon as this coded signal is no longer detected, due to a malfunction or disengagement of the contacts the device reverts to the high impedance state in step 220, in embodiments of the disclosed technology. Until step 235 is carried out again, and the contacts are re-engaged, the low-power state remains. It should be understood that switches to turn on and off power from the battery or to the power tool can further be used to limit the flow of electrical current/increase the impedance of electrical current from the battery to the business end of the electric tool.

Figure 6:
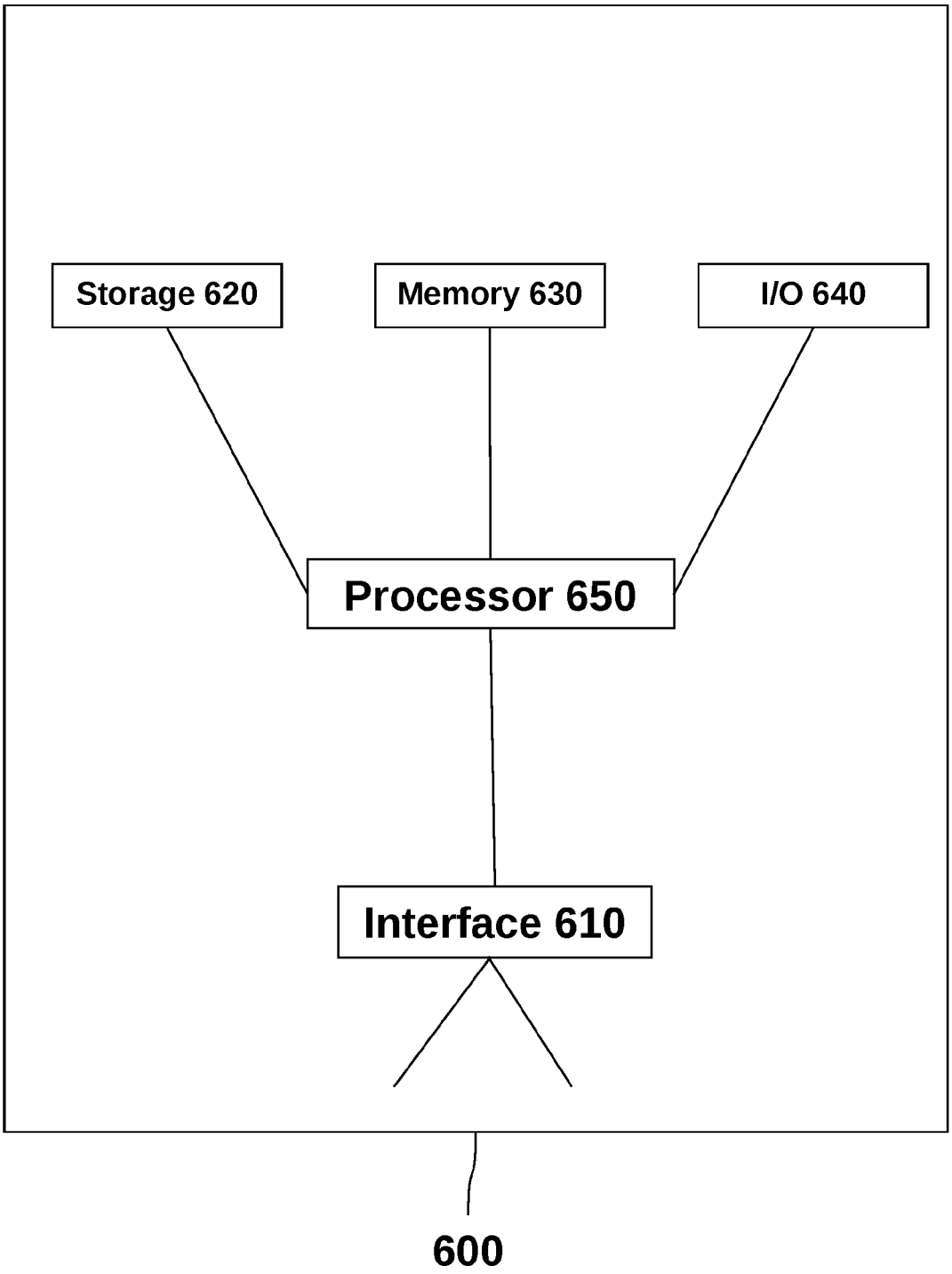
FIG. 6 shows a high-level block diagram of a device that may be used to carry out the disclosed technology.

FIG. 6 shows a high-level block diagram of a device that may be used to carry out the disclosed technology. Device 600 comprises a processor 650 that controls the overall operation of the computer, by executing the device's program instructions which define such operation. The device's program instructions may be stored in a storage device 620 (e.g., magnetic disk, database) and loaded into memory 630, when execution of the console's program instructions is desired. Thus, the device's operation will be defined by the device's program instructions stored in memory 630 and/or storage 620, and the console will be controlled by processor 650 executing the console's program instructions. A device 600 also includes one, or a plurality of, input network interfaces for communicating with other devices via a network (e.g., the internet). The device 600 further includes an electrical input interface. A device 600 also includes one or more output network interfaces 610 for communicating with other devices. Device 600 also includes input/output 640 representing devices which allow for user interaction with a computer (e.g., display, keyboard, mouse, speakers, buttons, etc.). One skilled in the art will recognize that an implementation of an actual device will contain other components as well, and that FIG. 6 is a high level representation of some of the components of such a device, for illustrative purposes. It should also be understood by one skilled in the art that the method and devices depicted in FIGS. 1 through 5 may be implemented on a device such as is shown in FIG. 6.

Further, it should be understood that all subject matter disclosed herein is directed to, and should be read only on, statutory, non-abstract subject matter. All terminology should be read to include only the portions of the definitions which may be claimed. By way of example, "computer readable storage medium" is understood to be defined as only non-transitory storage media.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

I claim:

1. An electrical system comprising:

a glove with first electrical contacts;

a power tool comprising second electrical contacts on a handle region thereof;

an electrical circuit within said power-tool electrically connected to said second electrical contacts which receives electrical current from a contact of said first electrical contacts in a high impedance state and outputs a coded signal;

a controller which switches said output from said contact of said first electrical contacts to a low impedance state upon receiving said coded signal.

2. The electrical system of claim 1, further comprising:

a battery; and an electrical cable in a sleeve of a garment connecting said battery to said first electrical contacts.

3. The electrical system of claim 2, wherein said controller is electrically connected to said electrical cable within said sleeve of said garment.

4. The electrical system of claim 3, wherein, upon said controller ceasing to receive said coded signal, said controller switches said output to said high impedance state.

5. The electrical system of claim 4, wherein a business end of said electrical tool is powered in said low impedance state and is unpowered in said high impedance state.

6. The electrical system of claim 2, wherein said battery is held in a harness hanging from said garment.

7. A method of using said electrical system of claim 6, comprising the steps of:

donning a garment with said electrical cable within said sleeve;

hanging said battery from said harness;

donning said glove with said first electrical contacts;

grasping said handle region of said power-tool, such that said first electrical contacts contact said second electrical contacts, causing said high impedance state to switch to said low impedance state;

using a business end of said power-tool;

releasing said handle of said power-tool, causing said low impedance state to return to said high impedance state.

8. The electrical system of claim 1, wherein, when said output is in a low impedance state, and said controller detects current outside of a pre-defined acceptable tolerance level, said controller switches said output to a high impedance state or cuts electrical flow entirely from a battery to said first electrical contacts.

9. A glove comprising:

first electrical contacts in an anterior region of said glove;

wires electrically connecting said electrical contacts to a controller and battery;

wherein, upon said first electrical contacts engaging with second electrical contacts of an electrically powered tool, and said controller receiving a coded signal therefrom, electrical output from said battery to said first electrical contacts is increased.

10. A kit comprising said glove of claim 9 and said electrically powered tool, said electrically powered tool comprising:

a handle with said second electrical contacts;

a signal generator operable to generate a coded signal upon said second electrical contacts contacting said first electrical contacts before said electrical output from said battery to said first electrical contacts is increased.

11. The kit of claim 10, wherein said electrically powered tool further comprises a business end thereof, which is operated only while said signal generator is generating said coded signal.

12. A kit comprising a glove, an electrically powered tool, wherein:

said electrically powered tool has a business end powered by way of two electrical contacts on a handle region;

said glove comprising two electrical contacts on an anterior side of said glove, such that spacing between said two electrical contacts of said glove and said two electrical contacts of said electrically powered tool are identical;

wherein said two electrical contacts of said glove output a first high impedance current source until contacting and completing an electrical circuit with said two electrical contacts of said electrically powered tool; and wherein, upon completing said electrical circuit, a second low impedance current source compared to said first high impedance current source is outputted through said two electrical contacts.

13. The kit of claim 12, wherein completing said electrical circuit causes said electrically powered tool to transmit a coded signal.

14. The kit of claim 13, wherein receipt of said coded signal causes said second low impedance current source to be connected through said two electrical contacts.

15. The kit of claim 13, wherein said high impedance state comprises at least 100 times the impedance of said low impedance state.

16. The electrical system of claim 1, wherein said high impedance state comprises at least 100 times the impedance of said low impedance state.

* * * * *